US007104632B2

(12) United States Patent
Song et al.

(10) Patent No.: US 7,104,632 B2
(45) Date of Patent: Sep. 12, 2006

(54) MONOLITHIC INK-JET PRINTHEAD AND METHOD FOR MANUFACTURING THE SAME

(75) Inventors: Hoon Song, Seoul (KR); Yong-soo Oh, Seongnam (KR); Jong-woo Shin, Suwon (KR); Chang-seung Lee, Seongnam (KR); Hyung-taek Lim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 164 days.

(21) Appl. No.: 10/726,515

(22) Filed: Dec. 4, 2003

(65) Prior Publication Data

US 2004/0109043 A1 Jun. 10, 2004

(30) Foreign Application Priority Data

Dec. 5, 2002 (KR) ..... 10-2002-0077000

(51) Int. Cl.
*B41J 2/05* (2006.01)
*B41J 2/135* (2006.01)

(52) U.S. Cl. ..... 347/61; 347/45

(58) Field of Classification Search ..... 347/29, 347/33, 47, 45, 56, 61, 63
See application file for complete search history.

(56) References Cited

U.S. PATENT DOCUMENTS 4,882,595 A 11/1989 Trueba et al.
5,859,654 A * 1/1999 Radke et al. ..... 347/45
6,019,457 A * 2/2000 Silverbrook ..... 347/65
6,243,112 B1 * 6/2001 Kuhman et al. ..... 347/45
6,273,555 B1 * 8/2001 Hess ..... 347/63
6,460,970 B1 10/2002 Ohkuma et al.
6,663,226 B1 * 12/2003 Min et al. ..... 347/58
2002/0008738 A1 1/2002 Lee et al. ..... 347/62

FOREIGN PATENT DOCUMENTS

EP 1 215 048 A2 6/2002
EP 1 215 048 A3 6/2002

* cited by examiner

*Primary Examiner*—Stephen Meier
*Assistant Examiner*—Geoffrey S. Mruk
(74) *Attorney, Agent, or Firm*—Lee & Morse, P.C.

(57) ABSTRACT

A monolithic ink-jet printhead includes a substrate which has an ink chamber to be supplied with ink, a manifold for supplying ink to the ink chamber, and an ink channel for providing communication between the ink chamber and the manifold, a nozzle plate including a plurality of passivation layers sequentially stacked on the substrate, a metal layer formed on the passivation layers, and a nozzle, through which ink is ejected from the ink chamber, that penetrates the nozzle plate, a heater provided between adjacent passivation layers, the heater being located above the ink chamber for heating ink within the ink chamber, a conductor provided between adjacent passivation layers, the conductor being electrically connected to the heater for applying a current to the heater, and a hydrophobic coating layer formed exclusively on an outer surface of the metal layer.

13 Claims, 11 Drawing Sheets

MONOLITHIC INK-JET PRINTHEAD AND METHOD FOR MANUFACTURING THE SAME

BACKGROUND OF THE INVENTION

1. Field of the Invention

The present invention relates to an ink-jet printhead. More particularly, the present invention relates to a thermally driven, monolithic, ink-jet printhead having a nozzle plate that is formed integrally with a substrate and a hydrophobic coating layer formed on a surface of the nozzle plate, and a method for manufacturing the same.

2. Description of the Related Art

In general, ink-jet printheads are devices for printing a predetermined image, color or black, by ejecting a small volume ink droplet of a printing ink at a desired position on a recording sheet. Ink-jet printheads are largely classified into two types depending on the ink droplet ejection mechanisms: a thermally driven ink-jet printhead, in which a heat source is employed to form and expand a bubble in ink thereby causing an ink droplet to be ejected, and a piezoelectrically driven ink-jet printhead, in which a piezoelectric crystal bends to exert pressure on ink, thereby causing an ink droplet to be expelled.

An ink droplet ejection mechanism of the thermally driven ink-jet printhead will now be described in detail. When a pulse current flows through a heater formed of a resistive heating material, heat is generated by the heater to rapidly heat ink near the heater to approximately 300° C. Accordingly, the ink boils and bubbles are formed in the ink. The formed bubbles expand and exert pressure on the ink contained within an ink chamber. This causes a droplet of ink to be ejected through a nozzle from the ink chamber.

The thermally driven ink-jet printhead may be further subdivided into top-shooting, side-shooting, and back-shooting types depending on the direction of ink droplet ejection and the direction in which a bubble expands. The top-shooting type refers to a mechanism in which an ink droplet is ejected in a direction that is the same as a direction in which a bubble expands. The back-shooting type is a mechanism in which an ink droplet is ejected in a direction opposite to the direction in which the bubble expands. In the side-shooting type, the direction of ink droplet ejection is perpendicular to the direction in which the bubble expands.

Thermally driven ink-jet printheads need to meet the following conditions. First, a simple manufacturing process, low manufacturing cost, and mass production must be provided. Second, to produce high quality color images, a distance between adjacent nozzles must be as small as possible while still preventing cross-talk between the adjacent nozzles. More specifically, to increase the number of dots per inch (DPI), many nozzles must be arranged within a small area. Third, for high-speed printing, a cycle beginning with ink ejection and ending with ink refill must be as short as possible. That is, the heated ink and heater should cool down quickly to increase an operating frequency. Fourth, heat load exerted on the printhead due to heat generated by the heater must be small, and the printhead must operate stably under a high operating frequency.

FIG. 1A illustrates a partial cross-sectional perspective view of a structure of a conventional thermally driven printhead. FIG. 1B illustrates a cross-sectional view of the printhead of FIG. 1A for explaining a conventional process of ejecting an ink droplet.

Referring to FIGS. 1A and 1B, a conventional thermally driven ink-jet printhead includes a substrate 10, a barrier wall 14 disposed on the substrate 10 for defining an ink chamber 26 filled with ink 29, a heater 12 installed in the ink chamber 26, and a nozzle plate 18 having a nozzle 16 for ejecting an ink droplet 29'. If a pulse current is supplied to the heater 12, the heater 12 generates heat and a bubble 28 is formed due to the heating of the ink 29 contained within the ink chamber 26. The formed bubble 28 expands to exert pressure on the ink 29 contained within the ink chamber 26, thereby causing an ink droplet 29' to be ejected through the nozzle 16. Then, the ink 29 flows from a manifold 22 through an ink channel 24 to refill the ink chamber 26.

The process of manufacturing a conventional top-shooting type ink-jet printhead configured as above involves separately manufacturing the nozzle plate 18, which includes the nozzle 16 and the substrate 10, which includes the ink chamber 26 and the ink channel 24, and bonding them together. The manufacturing process is complicated and misalignment may occur during the bonding of the nozzle plate-18 and the substrate 10. Furthermore, since the ink chamber 26, the ink channel 24, and the manifold 22 are arranged on a same plane, there is a restriction on increasing the number of nozzles 16 per unit area, i.e., the density of nozzles 16. This restriction makes it difficult to implement a high printing speed, high-resolution ink-jet printhead.

Recently, in an effort to overcome the above problems of conventional ink-jet printheads, ink-jet printheads having a variety of structures have been proposed. FIG. 2 illustrates an example of a conventional monolithic ink-jet printhead.

Referring to FIG. 2, a hemispherical ink chamber 32 and a manifold 36 are formed on a front surface and a rear surface of a silicon substrate 30, respectively. An ink channel 34 is formed at a bottom of the ink chamber 32 and provides communication between the ink chamber 32 and the manifold 36. A nozzle plate 40, including a plurality of passivation layers 41, 42, and 43 stacked on the substrate 30, is formed integrally with the substrate 30.

The nozzle plate 40 has a nozzle 47 formed at a location corresponding to a central portion of the ink chamber 32. A heater 45 connected to a conductor 46 is disposed around the nozzle 47. A nozzle guide 44 extends along an edge of the nozzle 47 toward a depth direction of the ink chamber 32. Heat generated by the heater 45 is transferred through an insulating layer, which is the lowermost passivation layer 41, to ink 48 within the ink chamber 32. The ink 48 then boils to form bubbles 49. The formed bubbles 49 expand to exert pressure on the ink 48 contained within the ink chamber 32, thereby causing an ink droplet 48' to be ejected through the nozzle 47. Then, the ink 48 flows through the ink channel 34 from the manifold 36 due to surface tension of the ink 48 contacting the air to refill the ink chamber 32.

A conventional monolithic ink-jet printhead configured as above has an advantage in that the silicon substrate 30 is formed integrally with the nozzle plate 40 thereby simplifying the manufacturing process and eliminating the chance of misalignment. Another advantage is that the nozzle 46, the ink chamber 32, the ink channel 34, and the manifold 36 are arranged vertically to increase the density of nozzles 46, as compared with the conventional ink-jet printhead shown in FIG. 1A.

In a conventional ink-jet printhead, since ink is ejected as an ink droplet, the ink must be ejected in a discrete ink droplet form to provide acceptable printing performance. In an ink-jet printhead, a size, a shape, and a surface property of the nozzle greatly affect a size of the ejected ink droplet, a stability of the ink droplet ejection, and an ejection speed of the ink droplet. In particular, the surface property of the nozzle plate greatly affects the characteristic of the ink ejection.

In the ink-jet printhead shown in FIG. 2, the passivation layers 41, 42, and 43 formed around the heater 45 are formed using low heat conductive insulating materials, such as oxide or nitride, for purposes of providing electrical insulation. Thus, a considerable amount of time is required for the heater 45, the ink 48 within the ink chamber 32, and a nozzle guide 44, all of which are heated during the ejection of the ink 48, to sufficiently cool and return to an initial state, thereby making it difficult to increase the operating frequency to a sufficient level.

In the ink-jet printhead shown in FIG. 2, since the nozzle plate 40 is relatively thin, it is difficult to secure a sufficient length of the nozzle 47. A small length of the nozzle 47 not only decreases the directionality of the ink droplet 48' ejected but also prohibits stable high-speed printing since the meniscus in the surface of the ink 48 after ejection of the ink droplet 48' retreats into the ink chamber 32. In an effort to solve these problems, the conventional ink-jet printhead has a nozzle guide 44 formed along the edge of the nozzle 47. However, if the nozzle guide 44 is too long, this not only makes it difficult to form the ink chamber 32 by etching the substrate 30 but also restricts expansion of the bubbles 49. Thus, the use of the nozzle guide 44 causes a restriction on sufficiently securing the length of the nozzle 47.

SUMMARY OF THE INVENTION

It is a feature of an embodiment of the present invention to provide a monolithic ink-jet printhead having a nozzle plate, which includes a thick metal layer, that is formed integrally with a substrate and a hydrophobic coating layer that is formed exclusively on an outer surface of the metal layer of the nozzle plate, thereby increasing the directionality of ink ejection and the ejection performance.

It is another feature of an embodiment of the present invention to provide a method for manufacturing the monolithic ink-jet printhead.

According to a feature of the present invention, there is provided a monolithic ink-jet printhead including a substrate having an ink chamber to be supplied with ink to be ejected, a manifold for supplying ink to the ink chamber, and an ink channel for providing communication between the ink chamber and the manifold, a nozzle plate including a plurality of passivation layers sequentially stacked on the substrate, a metal layer formed on the plurality of passivation layers, and a nozzle, through which ink is ejected from the ink chamber, that penetrates the nozzle plate, a heater provided between adjacent passivation layers of the plurality of passivation layers, the heater being located above the ink chamber for heating ink within the ink chamber, a conductor provided between adjacent passivation layers of the plurality of passivation layers, the conductor being electrically connected to the heater for applying a current to the heater, and a hydrophobic coating layer formed exclusively on an outer surface of the metal layer.

Preferably, the hydrophobic coating layer is made of a material having appropriate chemical resistance and abrasion resistance. Preferably, the hydrophobic coating layer is made of at least one material selected from the group consisting of a fluorine-containing compound and a metal. Preferably, the fluorine-containing compound is selected from the group consisting of polytetrafluoroethylene (PTFE) and fluorocarbon. Preferably, the metal is gold (Au).

Preferably, the metal layer is made of a material selected from the group consisting of nickel (Ni) and copper (Cu) and is formed by electroplating to a thickness of about 30–100 μm.

Preferably, the nozzle includes a lower nozzle formed through the plurality of passivation layers, and an upper nozzle formed through the hydrophobic coating layer and the metal layer. Preferably, the upper nozzle has a tapered shape in which a cross-sectional area decreases gradually toward an exit.

Preferably, the nozzle plate further includes a heat conductive layer, which is located above the ink chamber and insulated from the heater and the conductor, the heat conductive layer thermally contacting the substrate and the metal layer. Also preferably, the heat conductive layer is made of any one of a material selected from the group consisting of aluminum, aluminum alloy, gold, and silver.

According to another feature of the present invention, there is provided a method for manufacturing a monolithic ink-jet printhead including preparing a substrate; sequentially stacking a plurality of passivation layers on the substrate and forming a heater and a conductor connected to the heater between adjacent passivation layers of the plurality of passivation layers; forming a lower nozzle by etching to penetrate the plurality of passivation layers; forming a metal layer on the plurality of passivation layers, forming a hydrophobic coating layer exclusively on an outer surface of the metal layer, and forming an upper nozzle in communication with the lower nozzle by etching to penetrate the hydrophobic coating layer and the metal layer and etching an upper surface of the substrate exposed through the upper nozzle and the lower nozzle to form an ink chamber to be supplied with ink; and etching the substrate to form a manifold for supplying ink and an ink channel for providing communication between the ink chamber and the manifold.

Preferably, the substrate is made of a silicon wafer.

The method may further include forming a heat conductive layer which is located above the ink chamber, insulated from the heater and the conductor for thermally contacting the substrate and the metal layer between the passivation layers, during the sequentially stacking of the plurality of passivation layers on the substrate and the formation of the heater and the conductor. The heat conductive layer and the conductor may be simultaneously formed from the same metal. The heat conductive layer may be formed on the insulating layer after forming the insulating layer on the conductor. Preferably, the heat conductive layer is made of any one material selected from the group consisting of aluminum, aluminum alloy, gold, and silver.

Forming the lower nozzle may include dry etching the passivation layers within an area defined by the heater using reactive ion etching (RIE).

Forming the metal layer, forming the hydrophobic coating layer and forming the upper nozzle may include forming a seed layer for electroplating on the plurality of passivation layers, forming a plating mold for forming the upper nozzle on the seed layer, forming the metal layer on the seed layer by electroplating, forming the hydrophobic coating layer exclusively on the outer surface of the metal layer, and removing the plating mold and the seed layer formed under the plating mold. Forming the seed layer may include depositing at least one material selected from the group consisting of titanium and copper on the plurality of passivation layers. The seed layer may include a plurality of metal layers formed by sequentially stacking titanium and copper.

Forming the plating mold may include depositing a layer selected from the group consisting of photoresist and a photosensitive polymer on the seed layer to a predetermined thickness and then patterning the deposited layer in a shape corresponding to a shape of the upper nozzle. Forming the plating mold may further include patterning the deposited layer in a tapered shape, in which a cross-sectional area gradually increases in a downward direction, by a proximity exposure for exposing the deposited layer using a photomask which is installed to be separated from a surface of the deposited layer by a predetermined distance. An inclination of the plating mold may be adjusted by varying a distance between the photomask and the deposited layer and by varying an exposure energy.

The metal layer may be formed of a material selected from the group consisting of nickel and copper to a thickness of about 30–100 μm.

Preferably, the hydrophobic coating layer is made of at least one material selected from the group consisting of a fluorine-containing compound and a metal. Preferably, the fluorine-containing compound includes a material selected from the group consisting of polytetrafluoroethylene (PTFE) and fluorocarbon. Preferably, the metal is gold (Au).

Forming the hydrophobic coating layer may include compositely plating PTFE and nickel on the surface of the metal layer to a thickness of about 0.1 μm to several μm.

Forming the hydrophobic coating layer may include depositing fluorocarbon on the surface of the metal layer using a plasma enhanced chemical vapor deposition (PECVD) process to a thickness of several angstroms to hundreds of angstroms.

Forming the hydrophobic coating layer may include depositing gold on the surface of the metal layer using an evaporator to a thickness of about 0.1–1 μm.

Forming the ink chamber may include isotropically dry etching the substrate exposed through the nozzle. Forming the manifold and the ink chamber comprises etching a lower surface of the substrate to form the manifold, and etching to penetrate the substrate between the manifold and the ink chamber to form the ink channel.

BRIEF DESCRIPTION OF THE DRAWINGS

The above and other features and advantages of the present invention will become more apparent to those of ordinary skill in the art by describing in detail preferred embodiments thereof with reference to the attached drawings in which.

DETAILED DESCRIPTION OF THE INVENTION

Figure 1A:
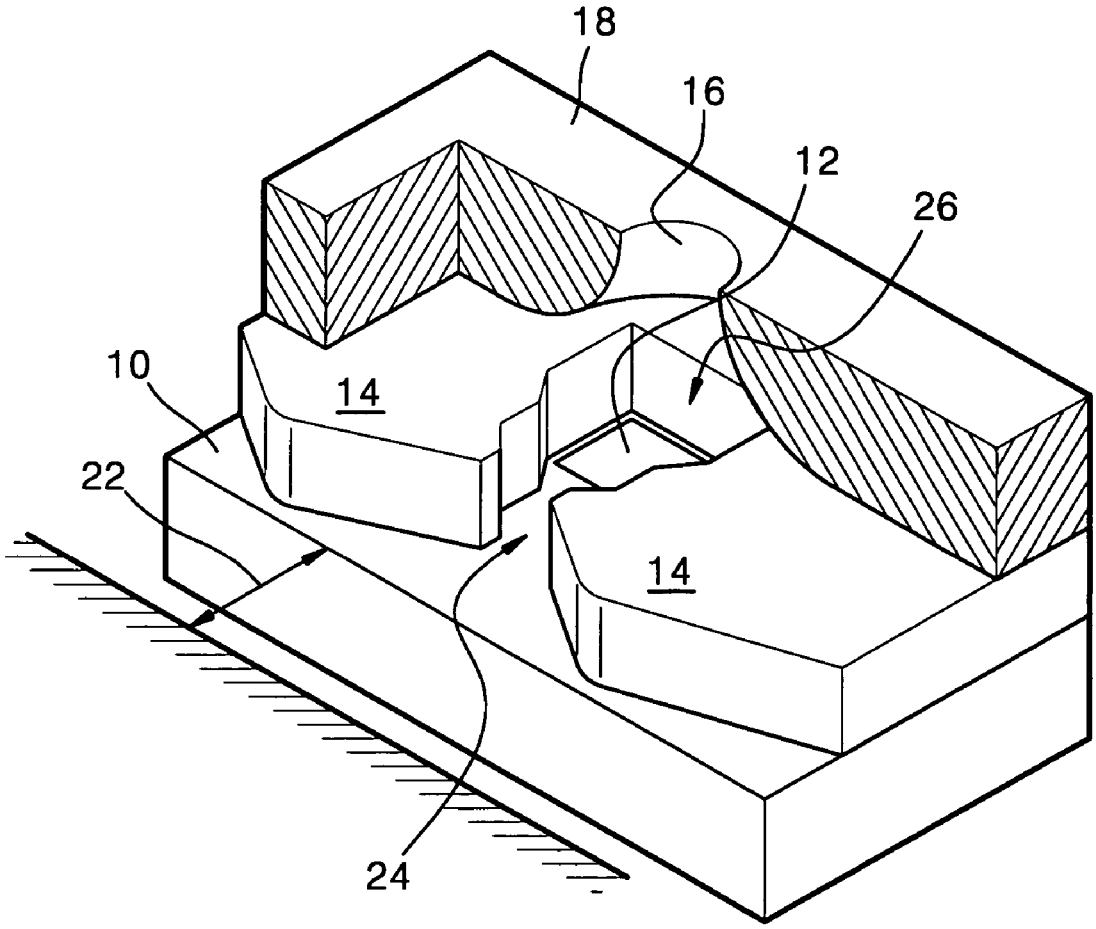
FIG. 1A (PRIOR ART)
FIGS. 1A and 1B illustrate a partial cross-sectional perspective view of a conventional thermally driven ink-jet printhead and a cross-sectional view for explaining a conventional process of ejecting an ink droplet, respectively.
Figure 1B:
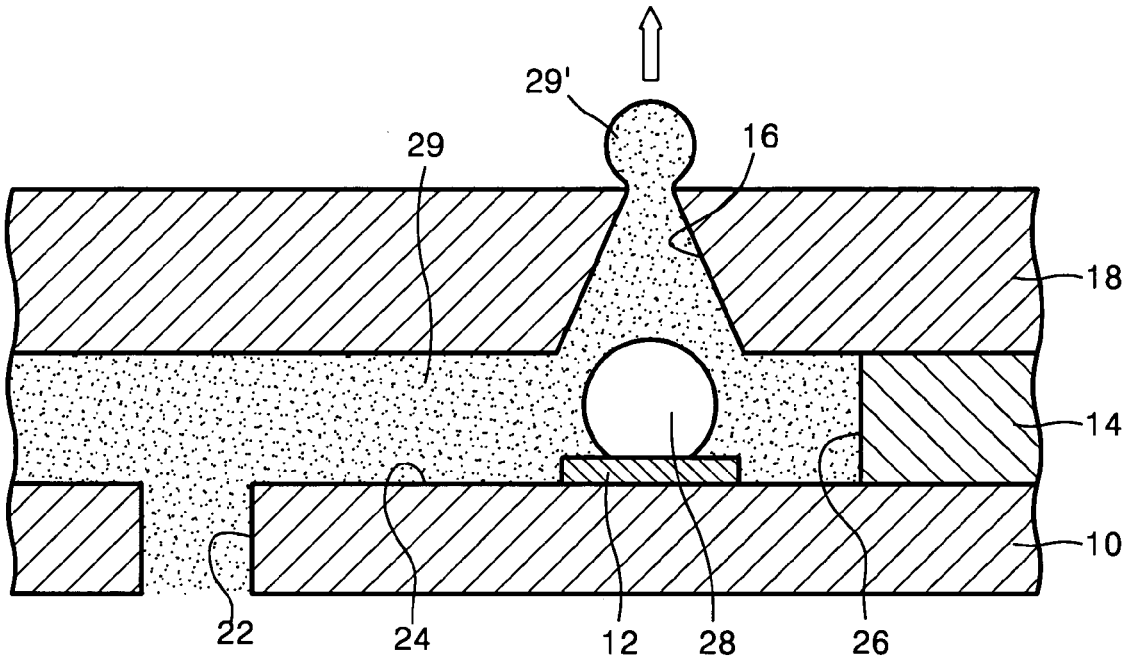
FIG. 1B (PRIOR ART)
Figure 2:
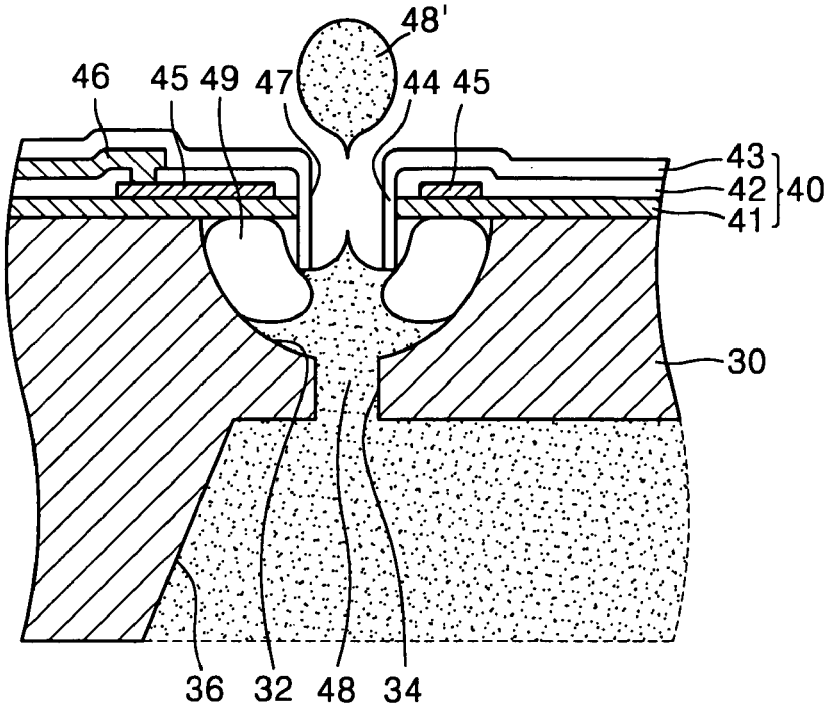
FIG. 2 (PRIOR ART)
FIG. 2 illustrates a vertical cross-sectional view of an example of a conventional monolithic ink-jet printhead.

Korean Patent Application No. 2002-77000, filed on Dec. 5, 2002, end entitled: "Monolithic Ink-Jet Printhead and Method for Manufacturing the Same," is incorporated by reference herein in its entirety.

The present invention will now be described more fully hereinafter with reference to the accompanying drawings, in which a preferred embodiment of the invention is shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, the thickness of layers and regions and the sizes of components may be exaggerated for clarity. It will also be understood that when a layer is referred to as being "on" another layer or substrate, it can be directly on the other layer or substrate, or intervening layers may also be present. Like reference numerals refer to like elements throughout.

Figure 3A:
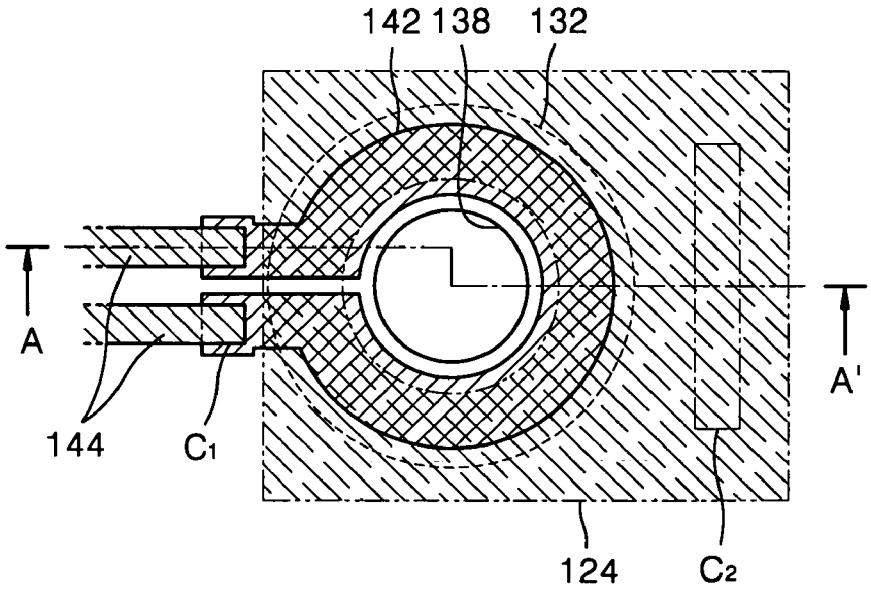
FIG. 3A illustrates a top view of a planar structure of a monolithic ink-jet printhead according to a preferred embodiment of the present invention.
Figure 3B:
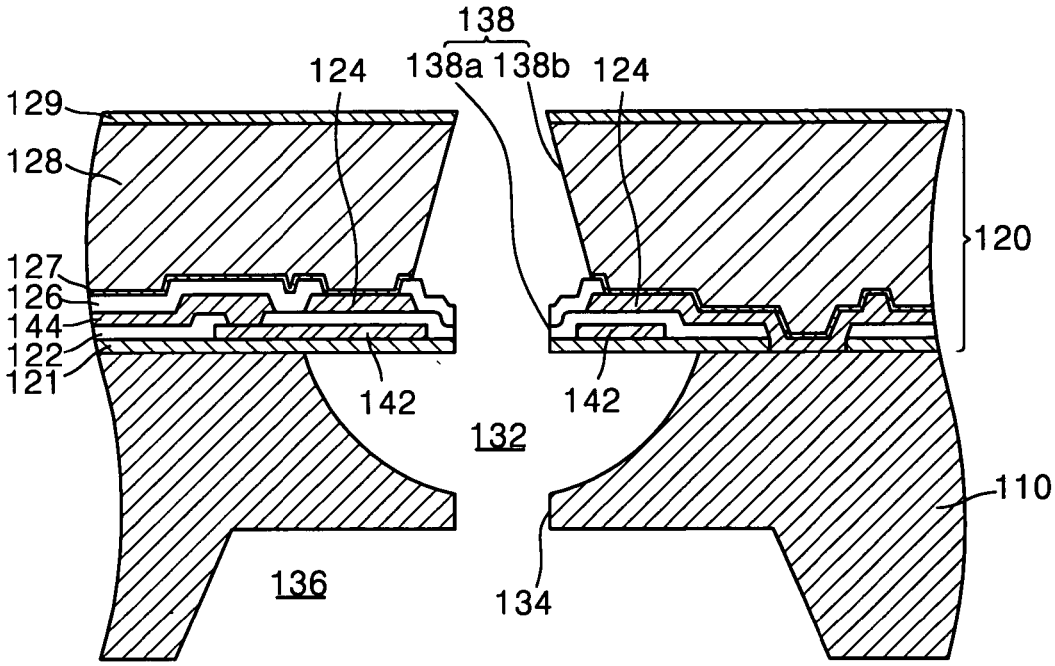
FIG. 3B illustrates a vertical cross-sectional view of the ink-jet printhead of the preferred embodiment of the present invention taken along line A–A' of FIG. 3A.

FIG. 3A illustrates a top view of a planar structure of a monolithic ink-jet printhead according to a preferred embodiment of the present invention. FIG. 3B illustrates a vertical cross-sectional view of the ink-jet printhead of the preferred embodiment of the present invention taken along line A–A' of FIG. 3A. Although only a unit structure of the ink-jet printhead has been shown in the drawings, the shown unit structure may be arranged in one or two rows, or in three or more rows to achieve a higher resolution in an ink-jet printhead manufactured in a chip state.

Referring to FIGS. 3A and 3B, an ink chamber 132 to be supplied with ink to be ejected, a manifold 136 for supplying ink to the ink chamber 132, and an ink channel 134 for providing communication between the ink chamber 132 and the manifold 136 are formed on a substrate 110 of an ink-jet printhead.

A silicon wafer widely used to manufacture integrated circuits (ICs) may be used as the substrate 110. The ink chamber 132 may be formed in a hemispherical shape or another shape having a predetermined depth on an upper surface of the substrate 110. The manifold 136, which is connected to an ink reservoir (not shown) for storing ink, may be formed on a lower surface of the substrate 110 to be positioned under the ink chamber 132. The ink channel 134 is formed between the ink chamber 132 and the manifold 136 to perpendicularly penetrate the substrate 110. The ink channel 134 may be formed in a central portion of a bottom surface of the ink chamber 132, and a horizontal cross-sectional shape is preferably circular. However, the ink channel 134 may have various horizontal cross-sectional shapes such as an oval or a polygonal shape. Further, the ink channel 134 may be formed at any other location that can provide communication between the ink chamber 132 and the manifold 136 by perpendicularly penetrating the substrate 110.

A nozzle plate 120 is formed on an upper surface of the substrate 110 having the ink chamber 132, the ink channel 134, and the manifold 136 formed thereon. The nozzle plate 120, which forms an upper wall of the ink chamber 132, has a nozzle 138, through which ink is ejected, at a location corresponding to a center of the ink chamber 132 by perpendicularly penetrating the nozzle plate 120.

The nozzle plate 120 includes a plurality of material layers stacked on the substrate 110. The plurality of material layers includes first, second, and third passivation layers 121, 122, and 126, a metal layer 128 stacked on the third passivation layer 126 by electroplating, and a hydrophobic coating layer 129 formed exclusively on an outer surface of the metal layer 128. A heater 142 is provided between the first and second passivation layers 121 and 122, and a conductor 144 is provided between the second and third passivation layers 122 and 126. A heat conductive layer 124 may be further provided between the second and third passivation layers 122 and 126.

The first passivation layer 121, the lowermost layer among the plurality of material layers forming the nozzle plate 120, is formed on the upper surface of the substrate 110. The first passivation layer 121 provides electrical insulation between the overlying heater 142 and the underlying substrate 110 and protection of the heater 142. The first passivation layer 121 may be made of silicon oxide or silicon nitride.

The heater 142 overlying the first passivation layer 121 and located above the ink chamber 132 for heating ink contained within the ink chamber 132 is centered around the nozzle 138. The heater 142 consists of a resistive heating material, such as polysilicon doped with impurities, tantalum-aluminum alloy, tantalum nitride, titanium nitride, and tungsten silicide. The heater 142 may have a shape of a circular ring centered around the nozzle 138, as shown in FIG. 3A, or another shape, such as a rectangular or a hexagonal shape.

A second passivation layer 122 for protecting the heater 142 is formed on the first passivation layer 121 and the heater 142. Similarly to the first passivation layer 121, the second passivation layer 122 may be made of silicon nitride or silicon oxide.

The conductor 144 electrically connected to the heater 142 for applying a pulse current to the heater 142 is formed on the second passivation layer 122. A first end of the conductor 144 is connected to the heater 142 through a first contact hole C, formed in the second passivation layer 122. The conductor 144 may be made of a highly conductive metal, such as aluminum, aluminum alloy, gold, or silver.

The heat conductive layer 124 may be provided above the second passivation layer 122. The heat conductive layer 124 functions to conduct heat from the heater 142 to the substrate 110 and the metal layer 128 which will be described later, and is preferably formed as widely as possible to entirely cover the ink chamber 132 and the heater 142. The heat conductive layer 124 needs to be separated from the conductor 144 by a predetermined distance for insulation purposes. The insulation between the heat conductive layer 124 and the heater 142 can be achieved by interposing the second passivation layer 122 therebetween. Furthermore, the heat conductive layer 124 contacts the upper surface of the substrate 110 through a second contact hole $C_2$ formed by penetrating the first and second passivation layers 121 and 122.

The heat conductive layer 124 is made of a metal having good conductivity. When both the heat conductive layer 124 and the conductor 144 are formed on the second passivation layer 122, the heat conductive layer 124 may be made of the same material as the conductor 144, such as aluminum, aluminum alloy, gold, or silver.

If the heat conductive layer 124 is formed thicker than the conductor 144 or made of a metal different from that of the conductor 144, an insulating layer (not shown) may be interposed between the conductor 144 and the heat conductive layer 124.

The third passivation layer 126 is provided on the conductor 144 and the second passivation layer 122 for providing electrical insulation between the overlying metal layer 128 and the underlying conductor 144 and for protecting of the conductor 144. The third passivation layer 126 may be made of tetraethylorthosilicate (TEOS) oxide or silicon oxide. It is preferable to avoid forming the third passivation layer 126 on an upper surface of the heat conductive layer 124 for contacting the heat conductive layer 124 and the metal layer 128.

The metal layer 128 is made of a metal having a high thermal conductivity, such as nickel or copper. The metal layer 128 is formed to a thickness in a range of about 30–100 μm, preferably, 45 μm or more, by electroplating the metal on the third passivation layer 126. To form the metal layer, a seed layer 127 for electroplating of the metal is provided on the third passivation layer 126. The seed layer 127 may be made of a metal having good electric conductivity and etching selectivity between the metal layer 128 and the seed layer 127, for example, titanium (Ti) or copper (Cu).

The metal layer 128 functions to dissipate the heat from the heater 142. Particularly, since the metal layer 128 is relatively thick due to the plating process, effective heat sinking is achieved. That is, the heat residing in or around the heater 142 after ink ejection is transferred to the substrate 110 and the metal layer 128 via the heat conductive layer 124 and then dissipated. This allows rapid heat dissipation after ink ejection and lowers the temperature around the nozzle 138, thereby providing stable printing at a high operating frequency.

As described above, the hydrophobic coating layer 129 is formed exclusively on the outer surface of the metal layer 128. Thus, the ink can be ejected in discrete ink droplet form due to the hydrophobic coating layer 129, thereby rapidly stabilizing the meniscus formed in the nozzle 138 after ink ejection. Further, the hydrophobic coating layer 129 can prevent the surface of the nozzle plate 120 from being contaminated by the ink or a foreign substance and provide improved directionality of the ink ejection. In the present invention, the hydrophobic coating layer 129 is formed exclusively on the outer surface of the metal layer 128 and is not formed on the inner surface of the nozzle 138. More specifically, the inner surface of the nozzle 138 maintains a hydrophilic property. Thus, the nozzle 138 can be sufficiently filled with the ink and the meniscus can be maintained in the nozzle 138.

Meanwhile, since the surface of the nozzle plate 120 is continuously exposed to the ink and air under a high temperature, the nozzle plate 120 corrodes due to ink and oxidizes due to oxygen in the air. The surface of the nozzle plate 120 is wiped periodically to remove residual ink. Thus, the hydrophobic coating layer 129 is required to have an appropriate chemical resistance to oxidization and corrosion and an appropriate abrasion resistance to friction. Therefore, in the printhead according to the present invention, the hydrophobic coating layer 129 is made of a material having an appropriate chemical resistance and abrasion resistance as well as a hydrophobic property. For example, the hydrophobic coating layer 129 may be formed of at least one of a fluorine-containing compound or a metal. Examples of the fluorine-containing compound preferably include polytetrafluoroethylene (PTFE) or fluorocarbon; an example of the metal preferably includes gold (Au).

As described above, the nozzle 138 is formed in the nozzle plate 120. The cross-sectional shape of the nozzle 138 is preferably circular. Alternately, the nozzle 138 may have other various cross-sectional shapes, such as an oval or a polygonal shape. The nozzle 138 includes a lower nozzle 138*a* and an upper nozzle 138*b*. The lower nozzle 138*a* is formed by perpendicularly penetrating the first, second, and third passivation layers 121, 122, and 126. The upper nozzle 138*b* is formed by perpendicularly penetrating the hydrophobic coating layer 129 and the metal layer 128. While the lower nozzle 138*a* has a cylindrical shape, it is preferable that the upper nozzle 138*b* has a tapered shape, in which a cross-sectional area gradually decreases toward an exit, as shown in FIG. 3B. In a case where the upper nozzle 138*b* has the tapered shape as described above, the meniscus in the ink surface after ink ejection is more rapidly stabilized.

Further, as described above, since the metal layer 128 of the nozzle plate 120 is relatively thick, the length of the nozzle 138 can be sufficiently secured. Thus, stable high-speed printing can be provided and the directionality of an ink droplet that is ejected through the nozzle 138 is improved. More specifically, the ink droplet can be ejected in a direction exactly perpendicular to the substrate 110.

An ink ejection mechanism for the ink-jet printhead according to the preferred embodiment of the present invention, as shown in FIGS. 3A and 3B, will now be described with reference to FIGS. 4A through 4C.

Figure 4A:
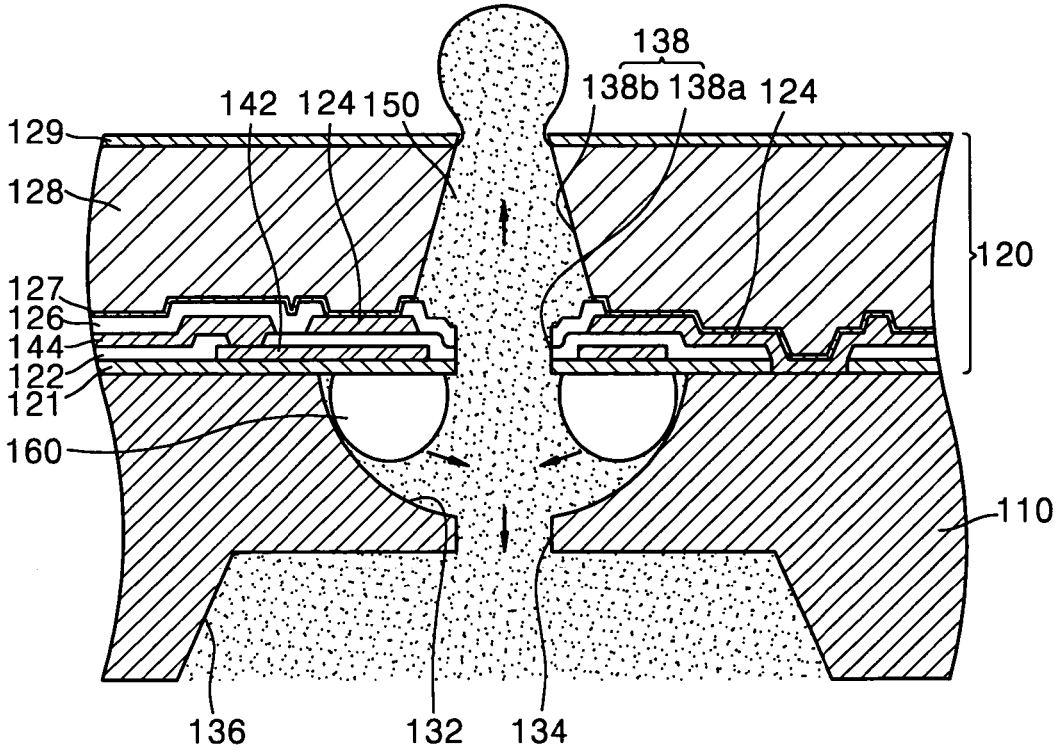
FIGS. 4A through 4C illustrate an ink ejection mechanism in a monolithic ink-jet printhead according to the present invention.

Referring to FIG. 4A, if a pulse current is applied to the heater 142 through the conductor 144 when the ink chamber 132 and the nozzle 138 are filled with ink 150, heat is generated by the heater 142. The generated heat is transferred through the first passivation layer 121 underlying the heater 142 to the ink 150 within the ink chamber 132 so that the ink 150 boils to form bubbles 160. As the formed bubbles 160 expand upon a continuous supply of heat, the ink 150 within the nozzle 138 is ejected out of the nozzle 138. At this time, the ink 150 ejected out of the nozzle 138 is prevented from running on the surface of the nozzle plate 120 by the hydrophobic coating layer 129 formed on the surface of the nozzle plate 120.

Figure 4B:
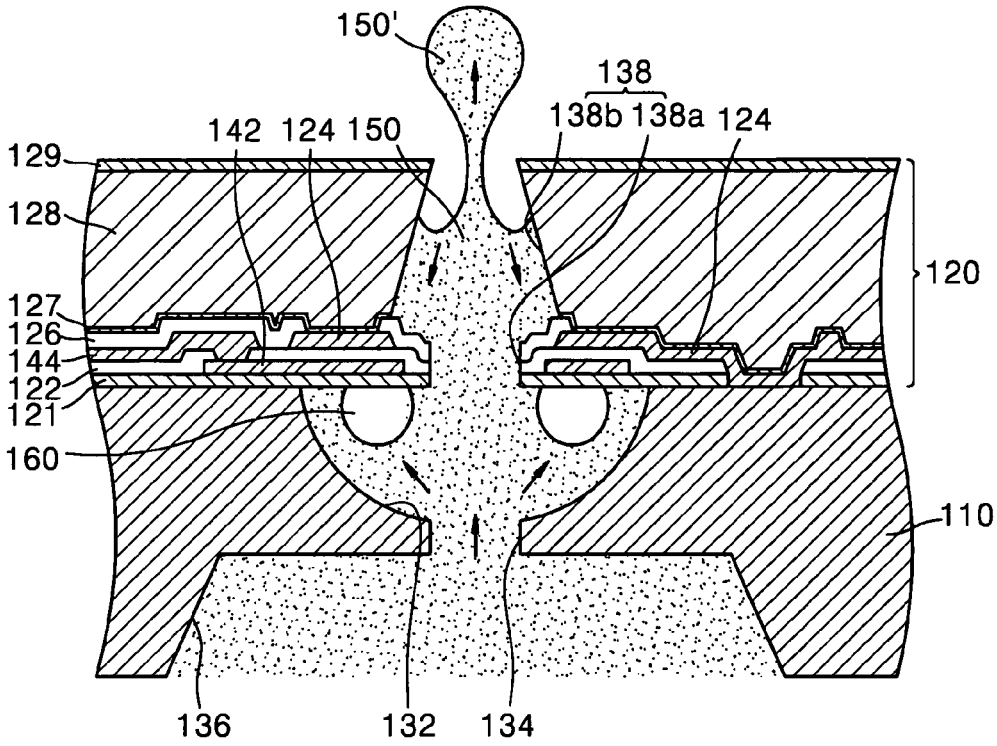

Referring to FIG. 4B, if the applied pulse current is interrupted when the bubble 160 expands to a maximum size thereof, the bubble 160 then shrinks until it collapses completely. At this time, a negative pressure is formed in the ink chamber 132 so that the ink 150 within the nozzle 138 returns to the ink chamber 132. At the same time, a portion of the ink 150 being pushed out of the nozzle 138 is separated from the ink 150 within the nozzle 138 and is ejected in the form of an ink droplet 150' due to an inertial force. At this time, since the hydrophobic coating layer 129 is formed on the surface of the nozzle plate 120 and the nozzle 138 has a sufficient length, the ink droplet 150' can be easily separated from the ink 150 within the nozzle 138 and the directionality of the ink droplet 150' can be improved.

A meniscus in the surface of the ink 150 formed within the nozzle 138 retreats toward the ink chamber 132 after the separation of the ink droplet 150'. In this arrangement, the nozzle 138 is sufficiently long due to the thick nozzle plate 120 so that the meniscus retreats only within the nozzle 138 and not into the ink chamber 132. Thus, this prevents air from flowing into the ink chamber 132 and quickly restores the meniscus to an original state, thereby stably maintaining high speed ejection of the ink droplet 150'. Further, since heat residing in or around the heater 142 after the separation of the ink droplet 150' passes through the heat conductive layer 124 and the metal layer 128 and is dissipated, either into the substrate 110 or out of the printhead, the temperature in or around the heater 142 and the nozzle 138 drops even more rapidly.

Figure 4C:
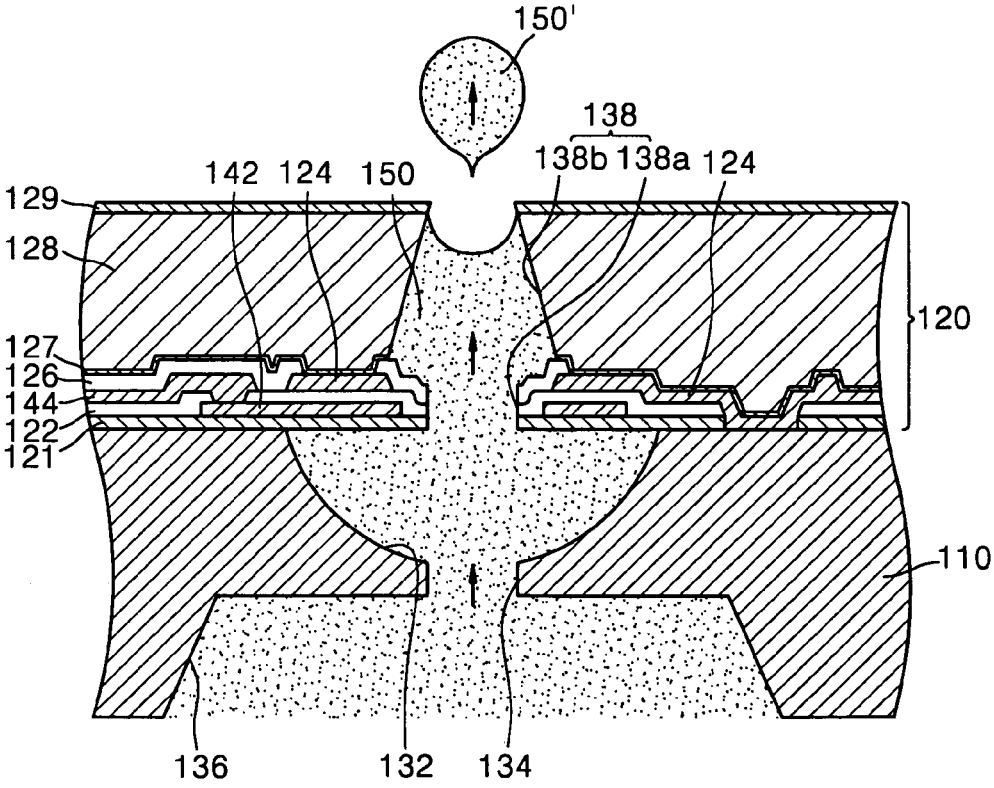

Next, referring to FIG. 4C, as the negative pressure within the ink chamber 132 disappears, the ink 150 again flows toward the exit of the nozzle 138 due to a surface tension force acting at the meniscus formed in the nozzle 138. The ink 150 is then supplied through the ink channel 134 to refill the ink chamber 132. At this time, since the inner surface of the nozzle 138 has a hydrophilic property, the nozzle 138 can be sufficiently filled with the ink 150. Particularly, when the upper nozzle 138*b* has the tapered shape, the speed at which the ink 150 flows upward further increases. When the refill of the ink 150 is completed so that the printhead returns to the initial state, the ink ejection mechanism is repeated. During the above process, the printhead can thermally recover the original state thereof more quickly because of heat dissipation through the heat conductive layer 124 and the metal layer 128.

A method for manufacturing a monolithic ink-jet printhead as presented above according to the preferred embodiment of the present invention, as shown in FIGS. 3A and 3B, will now be described.

FIGS. 5 through 16 illustrate cross-sectional views for explaining stages in a method for manufacturing the monolithic ink-jet printhead having the nozzle plate according to the preferred embodiment of the present invention.

Figure 5:
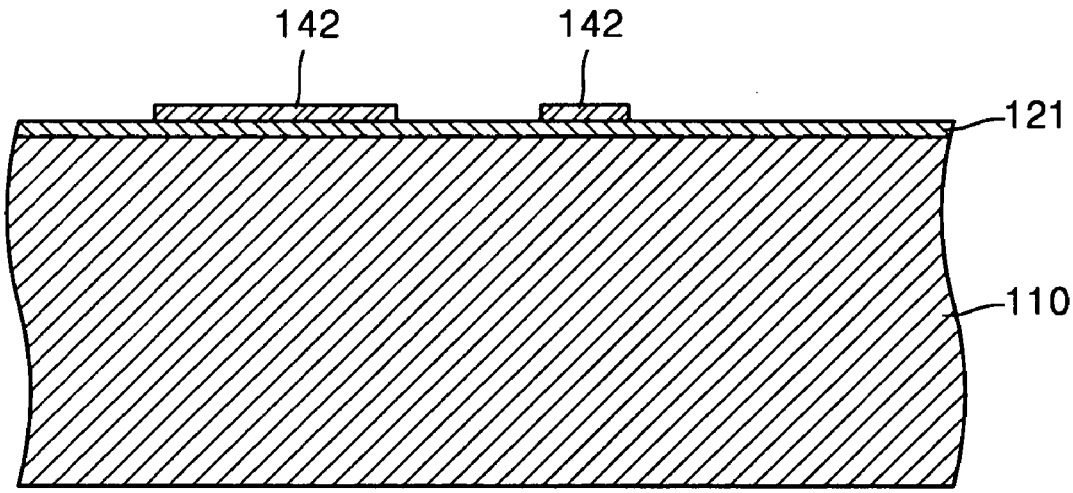
FIGS. 5 through 16 illustrate cross-sectional views for explaining stages in a method for manufacturing the monolithic ink-jet printhead according to the preferred embodiment of the present invention.

Referring to FIG. 5, a silicon wafer used for the substrate 110 has been processed to have a thickness of approximately 300–500 μm. The silicon wafer is widely used for manufacturing semiconductor devices and is effective for mass production.

While FIG. 5 shows a very small portion of the silicon wafer, an ink-jet printhead according to the present invention can be manufactured in tens to hundreds of chips on a single wafer.

Initially, the first passivation layer 121 is formed on an upper surface of the prepared silicon substrate 110. The first passivation layer 121 may be formed by depositing silicon oxide or silicon nitride on the upper surface of the substrate 110.

Next, the heater 142 is formed on the first passivation layer 121 on the upper surface of the substrate 110. The heater 142 may be formed by depositing a resistive heating material, such as polysilicon doped with impurities, tantalum-aluminum alloy, tantalum nitride, titanium nitride, or tungsten silicide, on the entire surface of the first passivation layer 121 to a predetermined thickness and then patterning the same. Specifically, the polysilicon doped with impurities, such as a phosphorus (P)-containing source gas, may be deposited by low-pressure chemical vapor deposition (LPCVD) to a thickness of about 0.7–1 μm. Tantalum-aluminum alloy, tantalum nitride, titanium nitride, or tungsten silicide may be deposited by sputtering to a thickness of about 0.1–0.3 μm. The deposition thickness of the resistive heating material may be determined in a range other than that given here to have an appropriate resistance considering the width and length of the heater 142. The resistive heating material is deposited on the entire surface of the first passivation layer 121 and then patterned by a photo process using a photomask and a photoresist and an etching process using a photoresist pattern as an etch mask.

Figure 6:
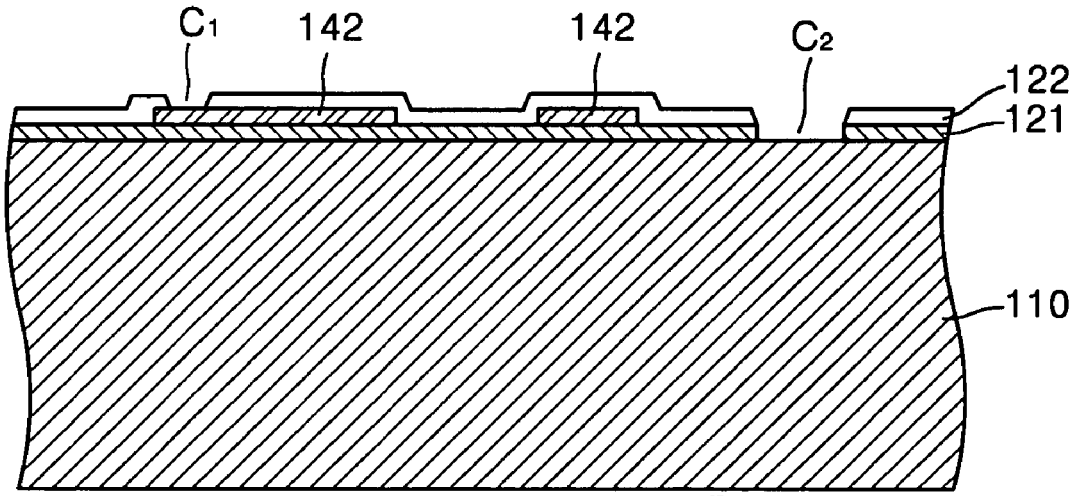
Figure 7:
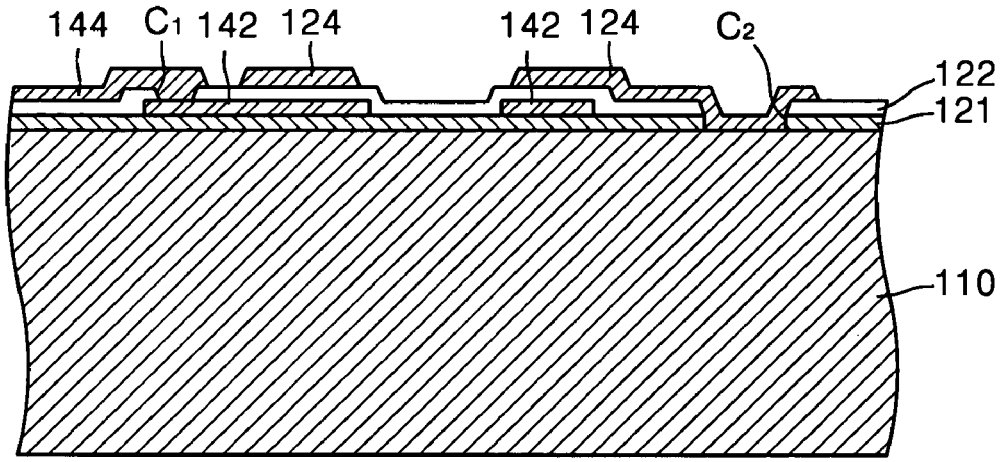

Subsequently, as shown in FIG. 6, the second passivation layer 122 is formed on the first passivation layer 121 and the heater 142 by depositing silicon oxide or silicon nitride to a thickness of about 0.5–3 μm. The second passivation layer 122 is then partially etched to form the first contact hole $C_1$ exposing a portion of the heater 142 to be connected with the conductor 144 in a subsequent step, which is shown in FIG. 7. The second and first passivation layers 122 and 121 are sequentially etched to form the second contact hole $C_2$ exposing a portion of the substrate 110 to provide a contact for the heat conductive layer 124 in the step shown in FIG. 7. The first and second contact holes $C_1$ and $C_2$ may be formed simultaneously.

FIG. 7 illustrates the stage in which the conductor 144 and the heat conductive layer 124 have been formed on the upper surface of the second passivation layer 122. Specifically, the conductor 144 and the heat conductive layer 124 can be formed at the same time by depositing a metal having excellent electric and thermal conductivity, such as aluminum, aluminum alloy, gold or silver, using a sputtering method to a thickness of about 1 μm and then patterning the same. At this time, the conductor 144 and the heat conductive layer 124 are formed insulated from one another, so that the conductor 144 is connected to the heater 142 through the first contact hole $C_1$ and the heat conductive layer 124 contacts the substrate 110 through the second contact hole $C_2$.

Alternatively, if the heat conductive layer 124 is to be formed thicker than the conductor 144 or if the heat conductive layer 124 is to be made of a metal different from that of the conductor 144, or to provide further insulation between the conductor 144 and the heat conductive layer 124, the heat conductive layer 124 can be formed after the formation of the conductor 144. More specifically, in the step shown in FIG. 6, after forming only the first contact hole $C_1$, the conductor 144 is formed. An insulating layer (not shown) is then formed on the conductor 144 and the second passivation layer 122. The insulating layer can be formed from the same material using the same method as the second passivation layer 122. The insulating layer and the second and first passivation layers 122 and 121 are then sequentially etched to form the second contact hole $C_2$. Further, the heat conductive layer 124 is formed using the same method as the second passivation layer 122. Thus, the insulating layer is interposed between the conductor 144 and the heat conductive layer 124.

Figure 8:
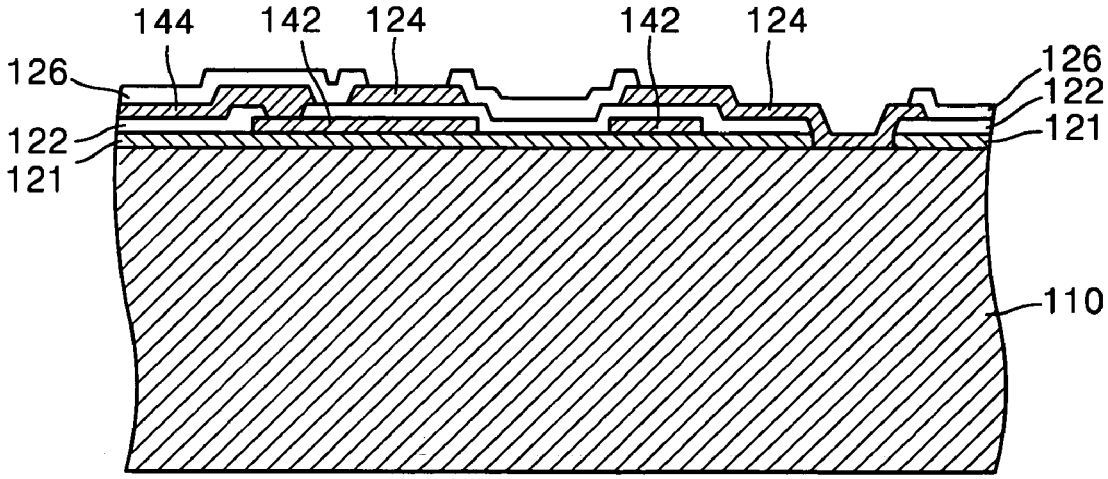

FIG. 8 illustrates the stage in which the third passivation layer 126 has been formed on the entire surface of the resultant structure of FIG. 7. Specifically, the third passivation layer 126 may be formed by depositing a tetraethylorthosilicate (TEOS) oxide using a plasma enhanced chemical vapor deposition (PECVD) process to a thickness of approximately 0.7–3 μm. Then, the third passivation layer 126 is partially etched to expose the heat conductive layer 124.

Figure 9:
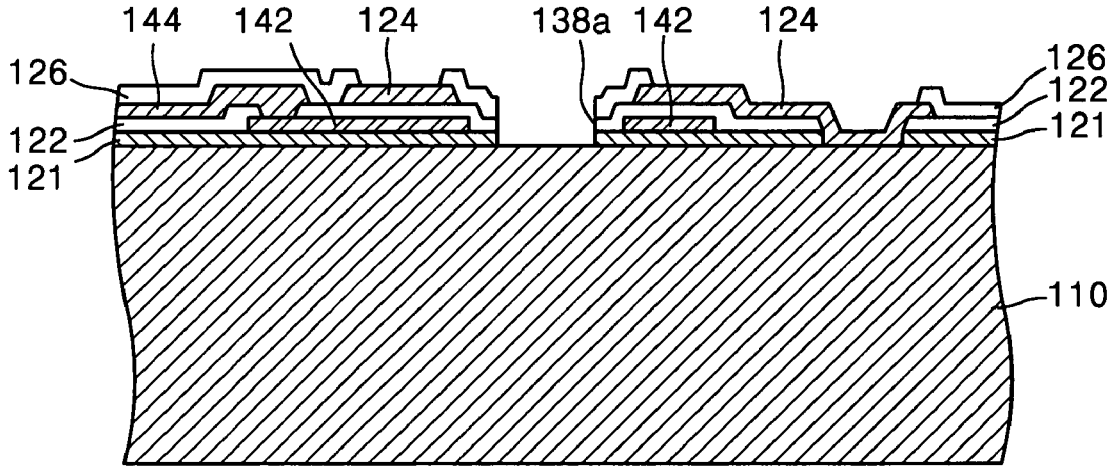

FIG. 9 illustrates the stage in which the lower nozzle 138*a* has been formed. The lower nozzle 138*a* is formed by sequentially etching the third, second, and first passivation layers 126, 122, and 121 within an area defined by the heater 142 using reactive ion etching (RIE).

Figure 10:
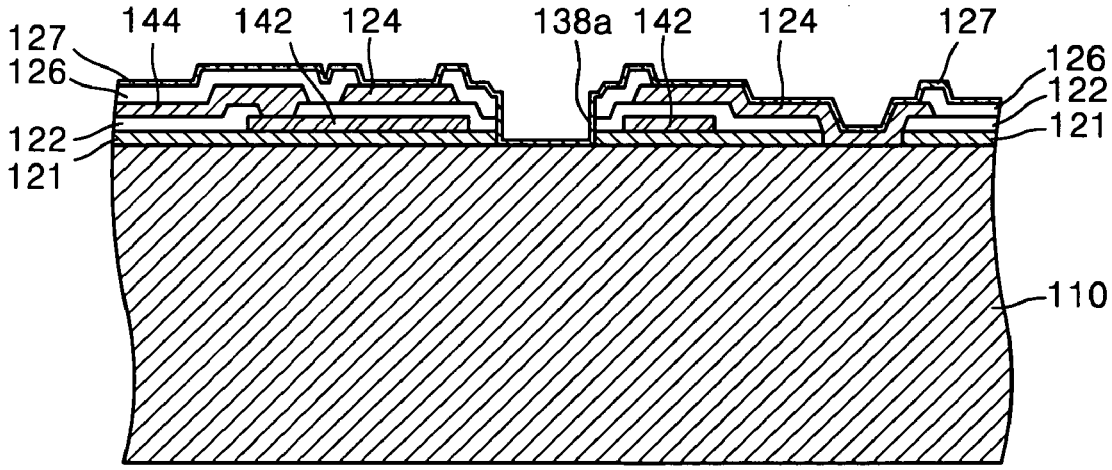

FIG. 10 illustrates the stage in which a seed layer 127 for electroplating has been formed on the entire surface of the resultant structure of FIG. 9. To perform the electroplating, the seed layer 127 can be formed by depositing a metal having good conductivity, such as titanium (Ti) or copper (Cu), to a thickness of approximately 100–1,000 Å using a sputtering method. The metal forming the seed layer 127 is determined in consideration of the etching selectivity between the metal layer 128 and the seed layer 127 as will be described later. Meanwhile, the seed layer 127 may be formed in a composite layer by sequentially stacking nickel (Ni) and copper (Cu).

Figure 11:
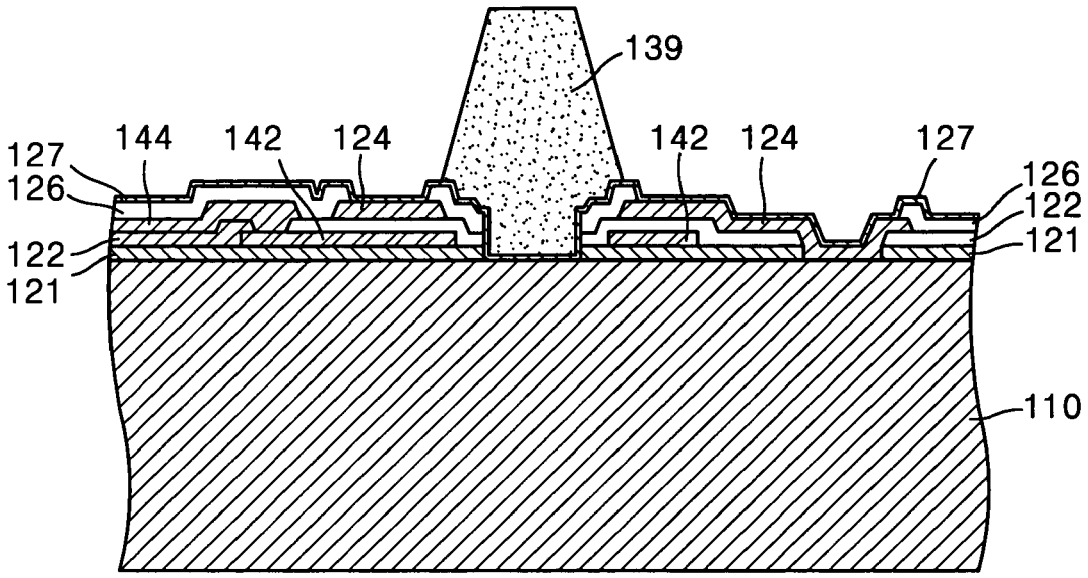

Next, as shown in FIG. 11, a plating mold 139 for forming the upper nozzle (138*b* of FIG. 14) is prepared. The plating mold 139 can be formed by applying photoresist on the entire surface of the seed layer 127 to a predetermined thickness, and then patterning the photoresist in the same shape as that of the upper nozzle 138*b*. Alternately, the plating mold 139 may be made of photosensitive polymer. Specifically, the photoresist is first applied on the entire surface of the seed layer 127 to a thickness slightly higher than a height of the upper nozzle 138*b*. At this time, the photoresist fills the lower nozzle 138*a*. Next, the photoresist is patterned to remain only in a portion where the upper nozzle 138*b* will be formed and the photoresist filled in the lower nozzle 138*a*. At this time, the photoresist is patterned in a tapered shape in which a cross-sectional area gradually increases in a downward direction. The patterning process can be performed by a proximity exposure process for exposing the photoresist using a photomask which is separated from an upper surface of the photoresist by a predetermined distance. In this case, light passed through the photomask is diffracted so that a boundary surface between an exposed area and a non-exposed area of the photoresist is inclined. An inclination of the boundary surface and the exposure depth can be adjusted by varying a distance between the photomask and the photoresist and by varying an exposure energy in the proximity exposure process. Meanwhile, the upper nozzle 138*b* may be formed in a cylindrical shape, and in that case, the photoresist is patterned in a pillar shape.

Figure 12:
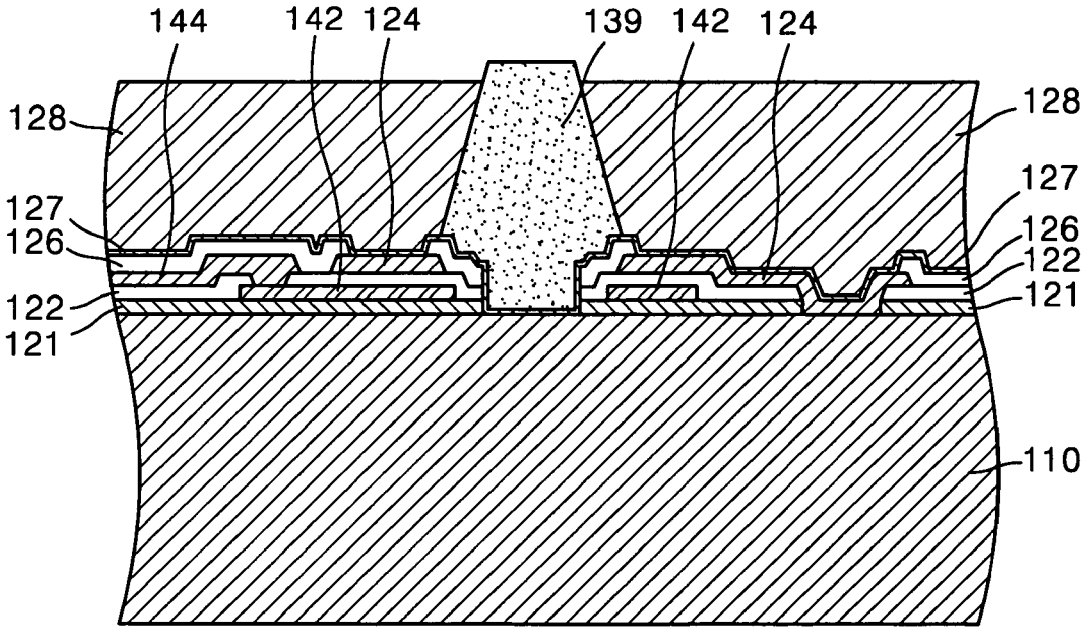

Next, as shown in FIG. 12, the metal layer 128 is formed to a predetermined thickness on the upper surface of the seed layer 127. The metal layer 128 can be formed to a thickness of about 30–100 μm, preferably about 45 μm or more, by electroplating nickel (Ni) or copper (Cu), preferably nickel (Ni), on the surface of the seed layer 127. Specifically, the plating process using nickel (Ni) can be performed using a nickel sulfamate solution. At this time, the plating process using nickel (Ni) is completed just before a top portion of the plating mold 139 is plated.

Figure 13:
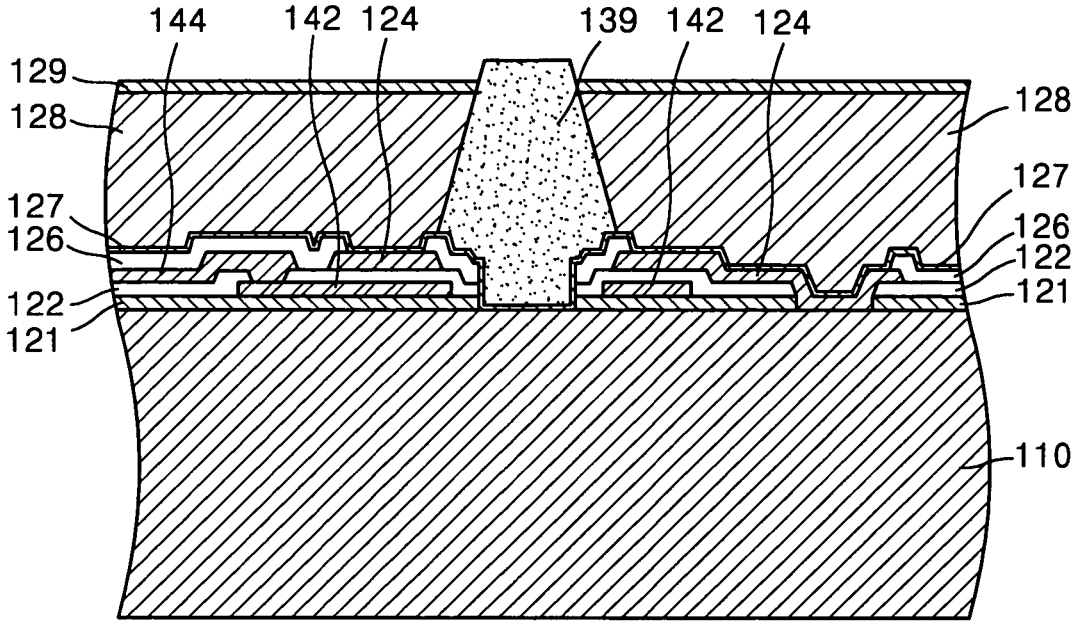

Next, as shown in FIG. 13, the hydrophobic coating 129 is formed on the surface of the metal layer 128. The hydrophobic coating layer 129, as described above, may be made of a material having the chemical resistance and the abrasion resistance, as well as the hydrophobic property. For example, the hydrophobic coating 129 is formed of at least one of a fluorine-containing compound and a metal. Examples of the fluorine-containing compound preferably include PTFE or fluorocarbon; an example of the metal preferably includes gold (Au).

During formation of the hydrophobic coating layer 129, the PTFE, fluorocarbon, or gold can be coated on the surface of the metal layer 128 to a predetermined thickness by an appropriate method. For example, when using PTFE, a metaflon process for compositely plating PTFE and nickel (Ni) on the surface of the metal layer 128 to a thickness of about 0.1 μm to several μm can be employed. Meanwhile, in a case of using fluorocarbon, fluorocarbon can be deposited on the surface of the metal layer 128 using a plasma enhanced chemical vapor deposition (PECVD) process to a thickness of several angstroms to hundreds of angstroms. At this time, fluorocarbon is deposited on the plating mold 139 and then the fluorocarbon deposited on the plating mold 139 can be removed together with the plating mold 139 in a subsequent process of removing the plating mold 139, which will be described below. When gold is used, gold can be formed on the surface of the metal layer 128 using an evaporator to a thickness of about 0.1–1 μm.

As described above, in the present invention, since the metal layer 128 and the hydrophobic coating 129 are formed after forming the plating mold 139 in a portion where the nozzle 138 will be formed, the hydrophobic coating 129 is formed exclusively on the outer surface of the metal layer 128 and is not formed inside the nozzle 138.

Figure 14:
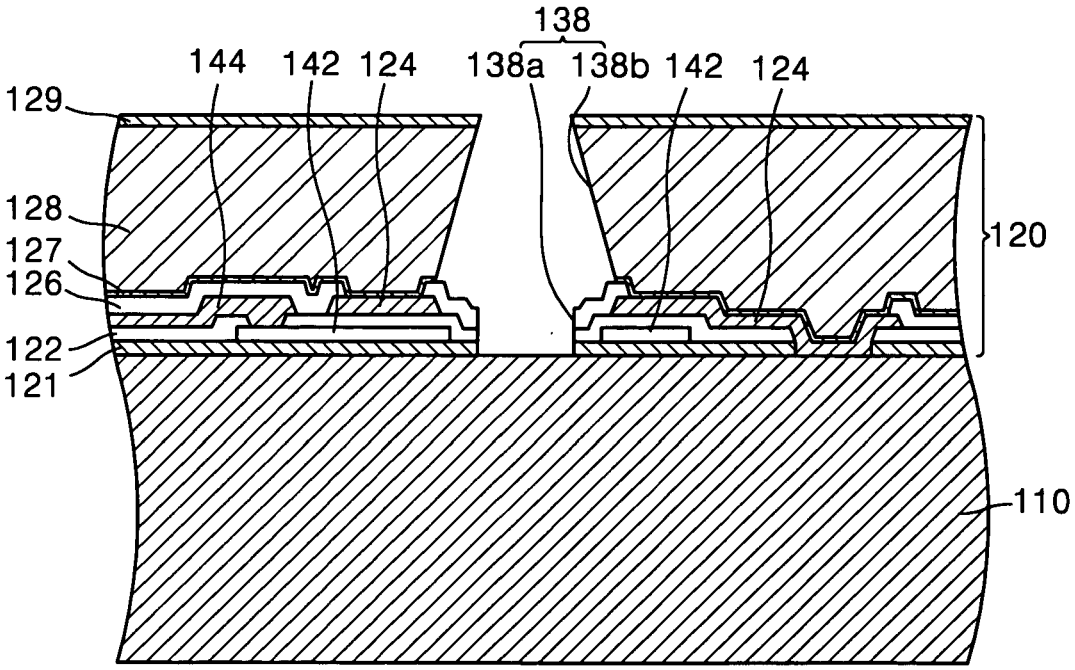

Subsequently, the plating mold 139 is removed, and then a portion of the seed layer 127 exposed by the removal of the plating mold 139 is removed. The plating mold 139 can be removed using a general photoresist removal method, for example, acetone. The seed layer 127 can be wet-etched using an etching solution, in which only the seed layer 127 can be selectively etched considering the etching selectivity between a material consisting of the metal layer 128 and a material consisting of the seed layer 127. For example, when the seed layer 127 is made of copper (Cu), an acetate base solution can be used as an etching solution, and when the seed layer 127 is made of titanium (Ti), an HF base solution can be used as an etching solution. As a result, as shown in FIG. 14, communication is provided between the lower nozzle 138*a* and the upper nozzle 138*b* to complete the nozzle 138 and the nozzle plate 120 formed by stacking the plurality of material layers is completed.

Figure 15:
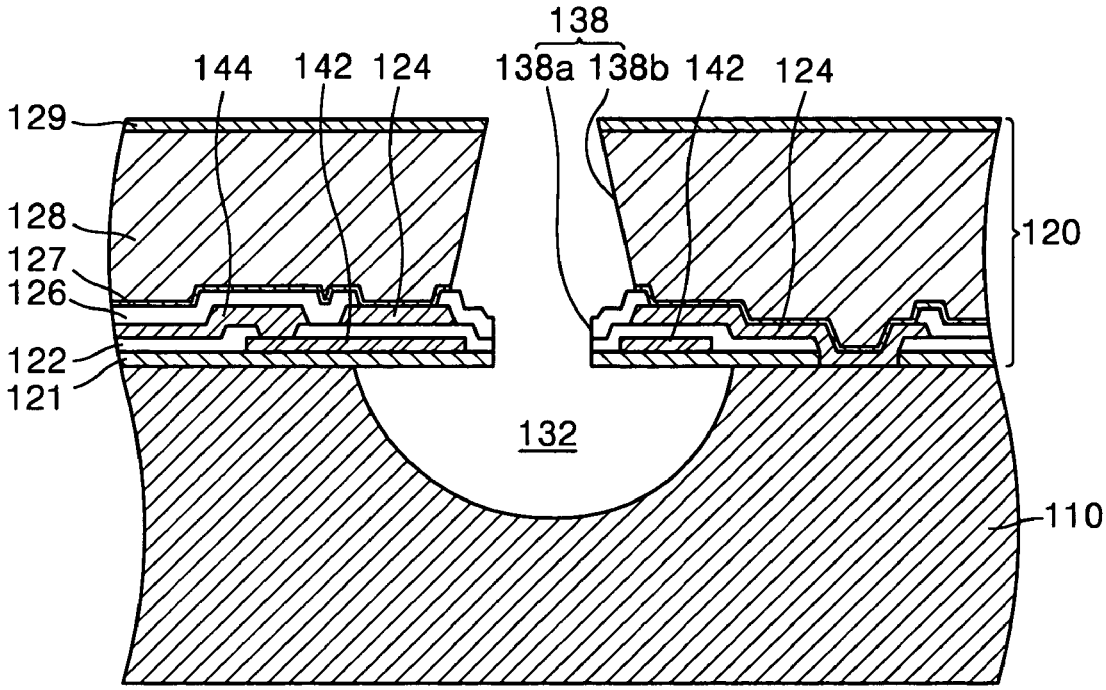

FIG. 15 illustrates the stage in which the ink chamber 132 of a predetermined depth has been formed on the upper surface of the substrate 110. The ink chamber 132 can be formed by isotropically etching the substrate 110 exposed by the nozzle 138. Specifically, dry etching is carried out on the substrate 110 using $XeF_2$ gas or $BrF_3$ gas as an etch gas for a predetermined time to form the hemispherical ink chamber 132 with a depth and a radius of about 20–40 μm as shown in FIG. 15.

Figure 16:
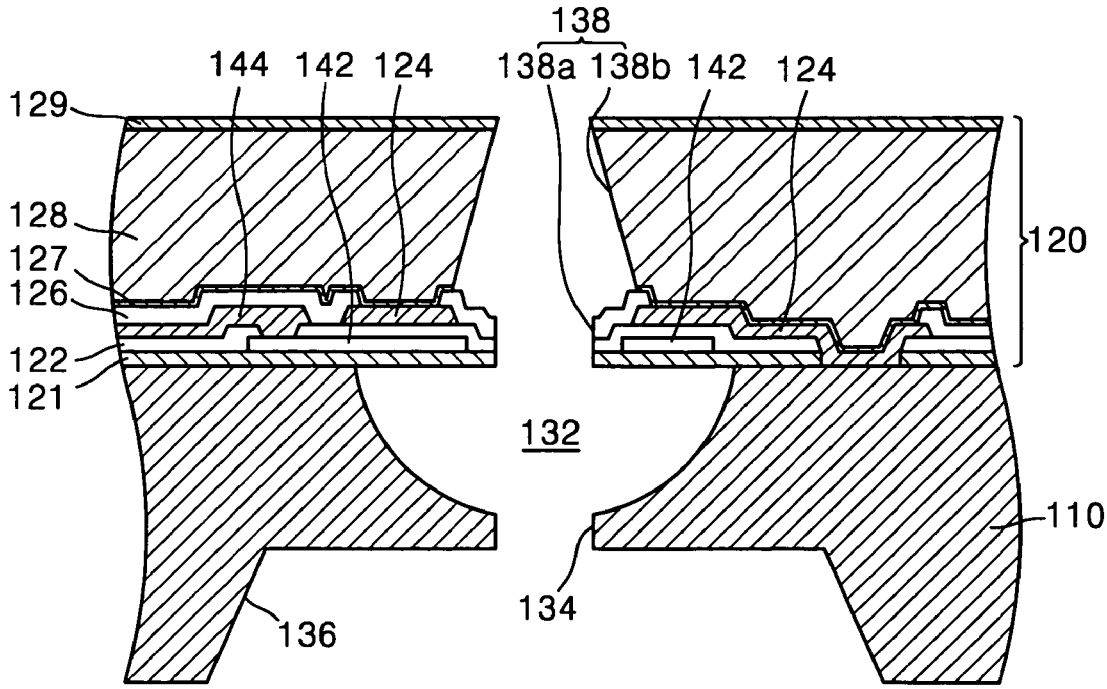

FIG. 16 illustrates the stage in which the manifold 136 and the ink channel 134 have been formed by etching the substrate 110 from the rear surface. Specifically, an etch mask that limits a region to be etched is formed on the rear surface of the substrate 110, and a wet etching on the rear surface of the substrate 110 is then performed using tetramethyl ammonium hydroxide (TMAH) or potassium hydroxide (KOH) as an etching solution to form the manifold 136 having an inclined side surface. Alternatively, the manifold 136 may be formed by anisotropically dry-etching the rear surface of the substrate 110. Subsequently, an etch mask that defines the ink channel 134 is formed on the rear surface of the substrate 110 where the manifold 136 has been formed, and the substrate 110 between the manifold 136 and the ink chamber 132 is then dry-etched by RIE, thereby forming the ink channel 134. Meanwhile, the ink channel 134 may be formed by etching the substrate 110 at the bottom of the ink chamber 132 through the nozzle 138.

After having undergone the above steps, the monolithic ink-jet printhead according to the preferred embodiment of the present invention having the structure as shown in FIG. 16 is completed.

As described above, a monolithic ink-jet printhead and a method for manufacturing the same according to the present invention have the following advantages.

First, since a metal layer and a hydrophobic coating layer are formed after forming a plating mold in a portion where a nozzle will be formed, the hydrophobic coating layer is formed exclusively on an outer surface of the metal layer so that the nozzle has a hydrophobic property. Thus, ink ejection factors such as directionality, size, and ejection speed of an ink droplet are improved, thereby increasing an operating frequency and improving a printing quality. Further, a surface of the printhead can be prevented from being contaminated and can have improved chemical resistance and abrasion resistance.

Second, the thick metal layer can be formed by electroplating so that a heat sinking capability is increased, thereby increasing the ink ejection performance and an operating frequency. Further, a sufficient length of the nozzle can be secured according to the thickness of the metal layer so that a meniscus can be maintained within the nozzle, thereby providing a stable ink refill operation, and improving the directionality of the ink droplet to be ejected.

Third, since a nozzle plate having a nozzle is formed integrally with a substrate having an ink chamber and an ink channel formed thereon, an ink-jet printhead can be manufactured on a single wafer using a single process. This process eliminates the conventional problem of misalignment between the ink chamber and the nozzle.

A preferred embodiment of the present invention has been disclosed herein and, although specific terms are employed, they are used and are to be interpreted in a generic and descriptive sense only and not for purpose of limitation. For example, materials used to form the constitutive elements of a printhead according to the present invention may not be limited to those described herein. In addition, the stacking and formation method for each material are only examples, and a variety of deposition and etching techniques may be adopted. Furthermore, specific numeric values illustrated in each step may vary within a range in which the manufactured printhead can operate normally. In addition, a sequence of process steps in a method of manufacturing a printhead according to this invention may vary. Accordingly, it will be understood by those of ordinary skill in the art that various changes in form and details may be made without departing from the spirit and scope of the present invention as set forth in the following claims.

What is claimed is:

1. A monolithic ink-jet printhead, comprising:

a substrate having an ink chamber to be supplied with ink to be ejected, a manifold for supplying ink to the ink chamber, and an ink channel for providing communication between the ink chamber and the manifold;

a nozzle plate including a plurality of passivation layers sequentially stacked on the substrate, a metal layer formed on the plurality of passivation layers, and a nozzle, through which ink is ejected from the ink chamber, that penetrates the nozzle plate;

a heater provided between adjacent passivation layers of the plurality of passivation layers, the heater being located above the ink chamber for heating ink within the ink chamber;

a conductor provided between adjacent passivation layers of the plurality of passivation layers, the conductor being electrically connected to the heater for applying a current to the heater; and a hydrophobic coating layer formed directly and exclusively on an outer surface of the metal layer.

2. The printhead as claimed in claim 1, wherein the hydrophobic coating layer is made of a material having chemical resistance and abrasion resistance.

3. The printhead as claimed in claim 2, wherein the hydrophobic coating layer is made of at least one material selected from the group consisting of a fluorine-containing compound and a metal.

4. The printhead as claimed in claim 3, wherein the fluorine-containing compound is selected from the group consisting of polytetrafluoroethylene (PTFE) and fluorocarbon.

5. The printhead as claimed in claim 3, wherein the metal is gold (Au).

6. The printhead as claimed in claim 1, wherein the metal layer is made of a material selected from the group consisting of nickel (Ni) and copper (Cu).

7. The printhead as claimed in claim 1, wherein the metal layer is formed by electroplating to a thickness of about 30–100 μm.

8. The printhead as claimed in claim 1, wherein the nozzle comprises:

a lower nozzle formed through the plurality of passivation layers; and an upper nozzle formed through the hydrophobic coating layer and the metal layer.

9. The printhead as claimed in claim 8, wherein the upper nozzle has a tapered shape in which a cross-sectional area decreases gradually toward an exit.

10. The printhead as claimed in claim 1, wherein the nozzle plate further comprises:

a heat conductive layer, which is located above the ink chamber and insulated from the heater and the conductor, the heat conductive layer thermally contacting the substrate and the metal layer.

11. The printhead as claimed in claim 10, wherein the heat conductive layer is made of any one of a material selected from the group consisting of aluminum, aluminum alloy, gold, and silver.

12. An ink-jet printhead, comprising:

a nozzle;

an ink chamber disposed below the nozzle, the ink chamber having an inlet and an outlet, the outlet in communication with the nozzle;

a heater disposed directly above and proximate to the ink chamber, the heater configured to heat ink in the ink chamber; and a plurality of layers disposed on the heater, the plurality of layers including, in sequence:

an insulation layer disposed on the heater and directly above the heater;

a first metal layer disposed on the insulation layer and directly above the heater;

a second metal layer disposed on the first metal layer and directly above the heater; and a hydrophobic layer disposed on the second metal layer and directly above the heater.

13. The inkjet printhead as claimed in claim 12, further comprising an electrically conductive layer that is electrically coupled to the heater.

* * * * *